US006336907B1

(12) United States Patent
Dono et al.

(10) Patent No.: US 6,336,907 B1
(45) Date of Patent: Jan. 8, 2002

(54) MASSAGING SYSTEM

(75) Inventors: Shigeru Dono, Osaka; Hitoshi Hata, Katano; Yukihiko Kitano, Nishinomiya, all of (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 09/448,452

(22) Filed: Nov. 24, 1999

(30) Foreign Application Priority Data

Nov. 25, 1998 (JP) ..... 10-334138

(51) Int. Cl.[7] ..... A61H 7/00
(52) U.S. Cl. ..... 601/150; 601/148
(58) Field of Search ..... 601/148–152, 601/134, 136, 46, 69, 51, 58; 128/DIG. 20

(56) References Cited

U.S. PATENT DOCUMENTS

| | | | | |
|---|---|---|---|---|
| 3,654,919 A | | 4/1972 | Birtwell | |
| 3,720,204 A | * | 3/1973 | Wojtowicz | 128/64 |
| 3,888,242 A | | 6/1975 | Harris et al. | |
| 4,175,297 A | * | 11/1979 | Robbins | 5/248 |
| 4,231,355 A | | 11/1980 | Hara | |
| 4,375,217 A | * | 3/1983 | Arkans | 128/24 R |
| 4,383,342 A | * | 5/1983 | Forster | 5/432 |
| 4,481,937 A | * | 11/1984 | Arkans | 128/24 R |
| 4,622,706 A | * | 11/1986 | Takeuchi | 5/453 |
| 5,211,162 A | * | 5/1993 | Gillen, Jr. et al. | 128/64 |
| 5,403,265 A | * | 4/1995 | Berguer et al. | 601/151 |
| 5,607,749 A | * | 3/1997 | Strumor | 428/156 |
| 5,815,864 A | * | 10/1998 | Sloop | 5/706 |
| 5,989,203 A | * | 11/1999 | Wang | 601/15 |
| 6,007,559 A | * | 12/1999 | Arkans | 606/201 |
| 6,212,719 B1 | * | 4/2001 | Thomas et al. | 5/713 |

FOREIGN PATENT DOCUMENTS

| | | |
|---|---|---|
| EP | 0 026 799 | 4/1981 |
| FR | 2 639 221 | 5/1990 |

* cited by examiner

*Primary Examiner*—Justine R. Yu
(74) *Attorney, Agent, or Firm*—Oblon, Spivak, McClelland, Maier & Neustadt, P.C.

(57) ABSTRACT

A massaging system includes a base sheet carrying a plurality of expandable bags arranged in a plane of the base sheet, and a charging and discharging unit connected to the bags for selectively supplying and discharging a pressurized fluid into and from the bags so as to inflate and deflate the bags, selectively. At least one applicator projects from each of the bags in contact with a portion of a human body for applying a massaging action. Each bag has a flexible top end capable of deforming into a curved contour when being inflated. The applicator is made of a hard material and projects directly from the top end wall of the bag as an integral part of the bag such that the applicator is caused to displace in a direction different from a direction along which the bag inflates and deflates principally, as a consequence of that the flexible top end wall deforms into the curved contour. Thus, the applicator can concentrate a massaging force resulting from the inflation of the bag to a particular portion of the user's body, giving a relatively strong local massage action sufficient for optimum treatment. Further, since the applicator takes a lateral movement in the direction generally perpendicular to the inflating direction during the inflation of the bag, the applicator can give a rubbing action, in addition to the pressing action, to the user's body for realizing effective and comfortable massage treatment analogous to that made by a human therapeutic massager.

12 Claims, 5 Drawing Sheets

MASSAGING SYSTEM

BACKGROUND ART

1. Field of the Invention

The present invention is directed to a massaging system, and more particularly to a massaging system utilizing a pressurized fluid to inflate and deflate selective ones of expandable bags arranged in an array for producing a massaging action to a human body.

2. Description of the Prior Art

U.S. Pat. No. 4,622,706 discloses a prior massaging system in the form of an air mat which comprises an array of expandable bags. A source of pressurized air is connected to the individual bags for selectively inflating and deflating the bags to give a massaging force applied to a human body lying on the mat. However, since the force generated by the inflation of the bag is distributed over substantially the entire surface of the bag, it is difficult to concentrate a relatively large force to a particular portion of a human body, failing to realize a strong massage action. This problem is somewhat solved in another massaging system as disclosed in U.S. Pat. No. 5,741,218. The patent utilizes a plurality of air bags each actuating an applicator in the form of a kneading ring so as to force the applicator against a user's body by inflating the corresponding bag. Thus, the inflation of the bag is translated into the massaging movement of the applicator. However, there is required a complicated structure for supporting the applicator on the bag in such a manner as to transmit the inflation of the bag made of the flexible bag to the massaging movement of the applicator made of a hard material. In fact, the applicator is mounted on a separate plate which is in turn supported to a base frame through a link mechanism allowing the applicator to move towards away from the base frame, while the bag is placed between the base frame and the plate. The use of such supporting mechanism makes it difficult to realize a compact massaging system at a minimum number of components, and particularly to design the massaging system which covers a wide area of the human body, yet which is lightweight and compact sufficient for easy adaptation in a bed, a bed, backrest of the chair, or even in a band placed around a leg or arm of the user.

SUMMARY OF THE INVENTION

The above problem and insufficiency have been reduced in a unique massaging system of the present invention. The massaging system comprises a base sheet carrying a plurality of expandable bags arranged in a plane of the base sheet, and a charging and discharging unit connected to the bags for selectively supplying and discharging a pressurized fluid into and from the bags so as to inflate and deflate the bags, selectively. At least one applicator projects from each of the bags and is adapted in use to come into contact with a portion of a human body for applying a massaging action. Each of the bags has a flexible top end wall which is capable of deforming into a curved contour when being inflated. The applicator is made of a hard material and projects directly from the top end wall of the bag as an integral part of the bag such that the applicator is caused to displace in a direction different from a direction along which said bag inflates and deflates principally, as a consequence of that the flexible top end wall deforms into the curved contour. Thus, the applicator can concentrate a massaging force resulting from the inflation of the bag to a particular portion of the user's body, giving a relatively strong local massage action for optimum treatment. In addition, since the applicator takes a lateral movement in the direction generally perpendicular to the inflating direction during the inflation of the bag, the applicator can give a rubbing action, in addition to the pressing action, to the user's body for realizing effective and comfortable massage treatment analogous to that made by a human therapeutic massager.

Accordingly, it is a primary object of the present invention to provide a massaging system which is capable of giving a relatively strong massage treatment locally to a particular portion of the user's body in an effective and comfortable manner, even with the use of the pressurized fluid for inflating and deflating the bags.

Preferably, each of the bags is formed of a flexible material in its entirety including the top end wall. Each of the applicators is made of a hard material which is inserted into a flexible sheath bonded to the top end wall of each bag. Thus, the applicator can be easily integrated with the bag without requiring any additional intervening supporting mechanism, assuring easy fabrication of the system.

The base sheet may be shaped into a rectangular configuration having a length and a width, and carry the bags which are of elongated configuration extending along the length of the base and are arranged in parallel with each other. The applicator on each of the bags is in the form of an elongated fin extending along a length of the bag, thereby enabling to concentrate the massage action over an extended portion of the user's body at a time.

In this connection, each bag may be provided with a parallel pair of the applicators which are so positioned on the flexible top end wall as to displace distal ends of the applicators away from each other as the bag is caused to inflate. Therefore, the applicators in the pair can act to stretch the portion of the user's body confined between the applicators, thereby realizing a comfortable treatment.

The bag is preferred to have a side wall in the form of a bellows so as to inflate the bag sufficiently without necessitating any substantial elastic deformation of the bag.

The charging and discharging unit responsible for inflating and deflating the bags may be configured to include a charging pump of supplying the pressurized fluid into the individual bags respectively through fluid channels, and a plurality of two-way valves provided respectively in the fluid channels for charging and discharging the pressurized fluid into and from the bags to inflate and deflate the bags. A suction pump is included to be connected to the valves through a common exhaust path for positively discharging the pressurized fluid out of the bags. Thus, the bags can be inflated and deflated at an increased rate to strengthen the massage action applied to the user's body.

The charging pump is connected to a common feed path from which the individual fluid channels are branched. The system may be additionally provided with a single temperature control unit which is disposed around the common feed path so as to heat or cool the pressurized fluid being supplied to the bags. Whereby, the user can enjoy the massage treatment in combination with a hot or cool treatment.

Alternatively, a plurality of temperature control units may be provided respectively around the individual fluid channels in order to control the temperature of the bags individually for realizing an optimum temperature distribution over the assembly of the bags.

It is preferred that the bags are grouped into a plurality of modules each having more than one bags. The modules are arranged within the plane of the base sheet to constitute a two-dimensional array having rows and columns of the bags. The system includes a controller which is programmed to inflate and deflate the bags successively along either one of the rows and columns. Thus, the massaging action can proceed selectively in different directions for optimum treatment to different portions of the user's body. In this connection, the bags of the elongated configuration extend along one of the rows and columns in parallel with each other within each module. The bags in each module are controlled to inflate and deflate successively to give a massaging wave proceeding in the order of the bags for applying successive treatment over a wide area of the user's body.

The base sheet may be made flexible to be deformable together with the bags into a desired contour so that it can be wound around arm or leg of the user to give the massage treatment thereto.

Further, at least one of the bags may be disposed to have the corresponding applicator positioned at a higher level than those of the remaining bags with respect to a general plane of the base sheet. Thus, the bags can be arranged in conformity with a curved contour of the human body so as to give a sufficient massage treatment to a recessed portion, for example, the lower back of the user's body.

These and still other objects and advantageous features of the present invention will become more apparent from the following description of the preferred embodiments when taken in conjunction with the attached drawings.

DETAILED DESCRIPTION OF THE EMBODIMENTS

Figure 1:
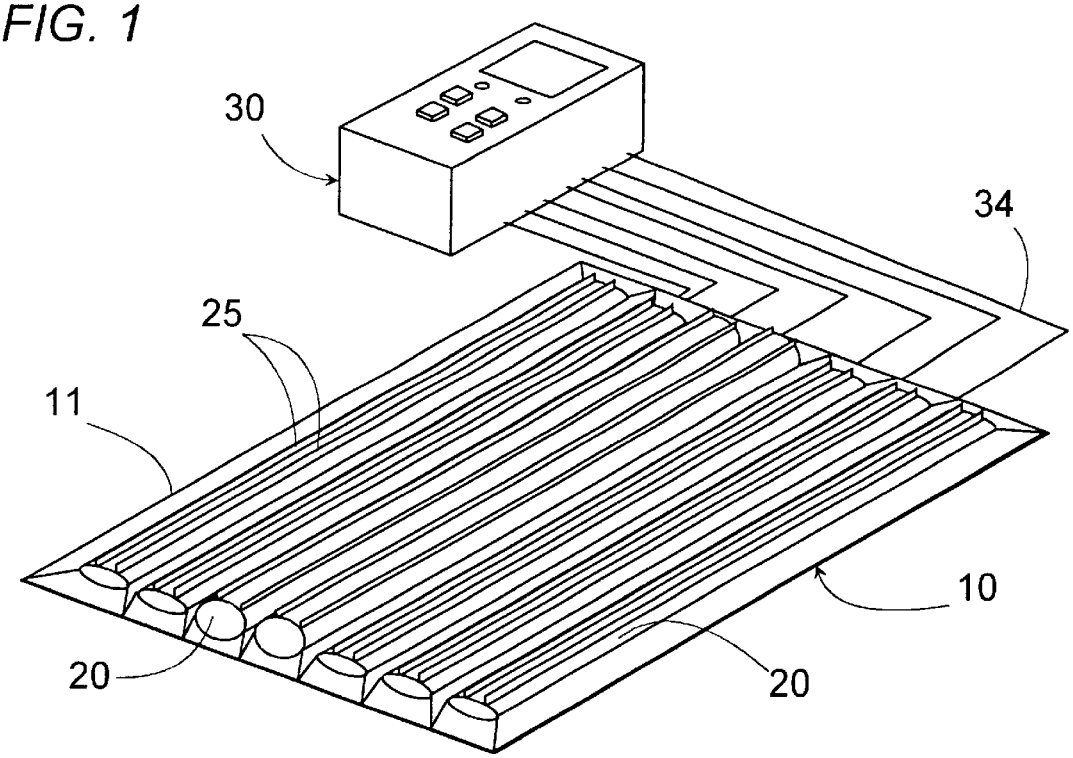
FIG. 1 is a perspective view of a massaging system in accordance with a first preferred embodiment of the present invention.
Figure 2:
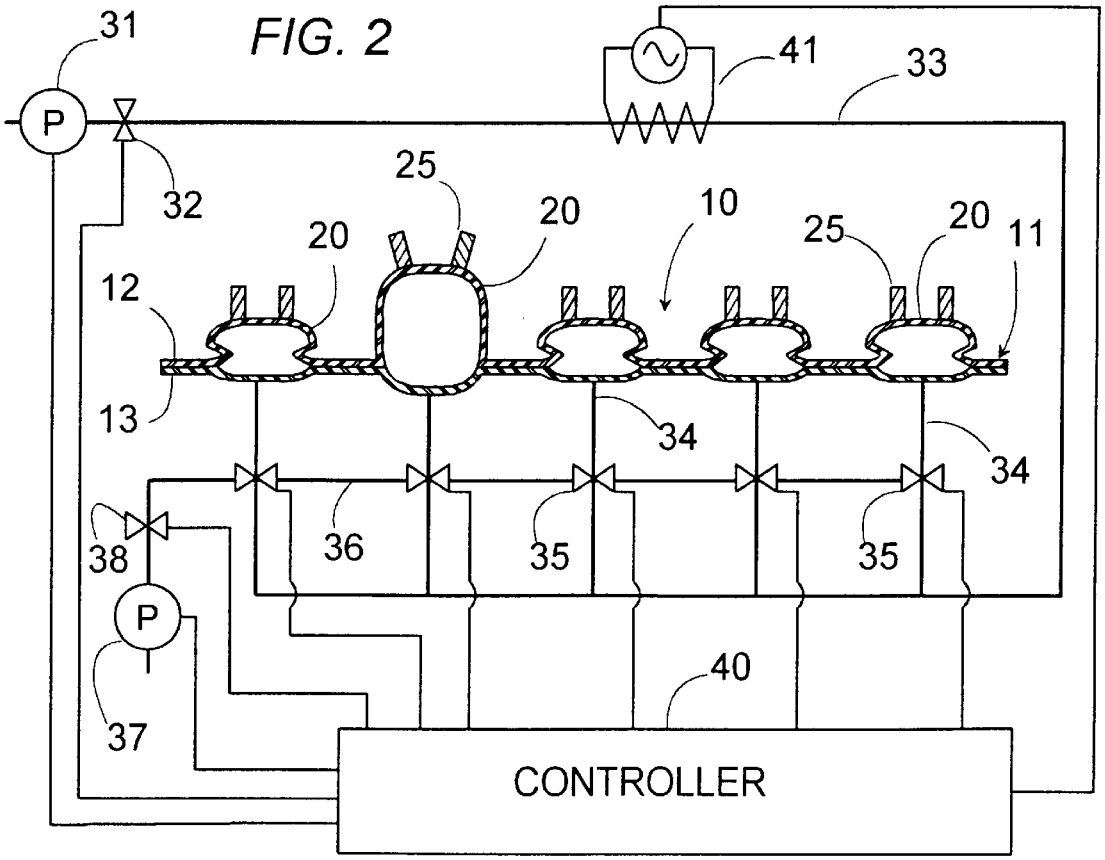
FIG. 2 is a schematic diagram of the above system.
Figure 3:
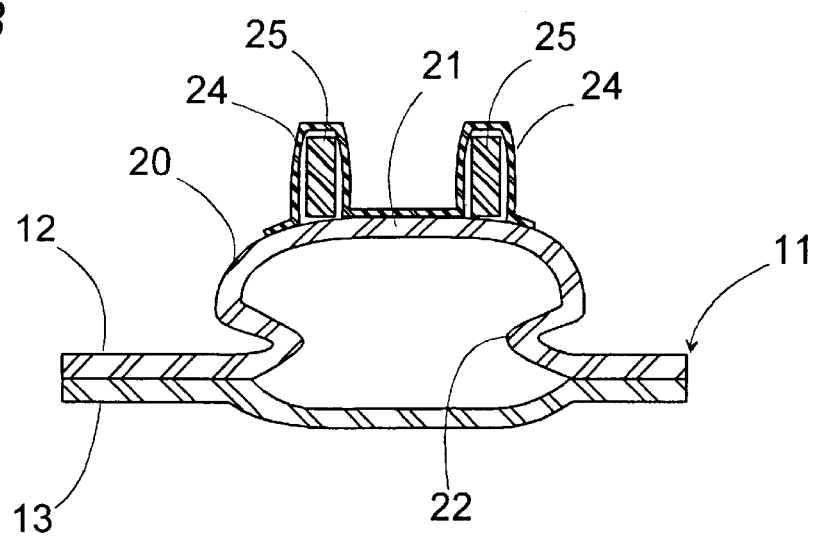
FIG. 3 is a sectional view of a portion of system.

Referring now to FIGS. 1 and 2, there is shown a massaging system in accordance with a first embodiment of the present invention. The system is composed of a massage unit 10 and a control unit 30. The massage unit 10 is provided in the form of a flexible mat which can be mounted on a bed or a backrest of a chair to apply massage treatment to the back of a user's body. The massage unit 10 comprises a base sheet 11 carrying a plurality of expandable bags 20 of elongated configuration arranged in parallel with each other. The base sheet 11 is composed of two layers 12 and 13 of flexible plastic resin material, for example, vinyl chloride resin or soft urethane resin, which are partially heat-welded to define the bags 20 between the unwelded portions of the layers. Each of thus formed bags 20 is provided on its top end wall 21 with a pair of applicators 25 each in the form of a fin extending along the entire length of the bag for contact with a portion of the user's body to apply a massaging force. The applicator 25 is made of a hard plastic material, for example, hard urethane resin, and is inserted into a flexible sheath 24 bonded to the bag. The sheath 24 is also made of the same material as forming the base sheet and is heat-welded to the bag to give a unitary structure in which the applicators 25 project directly from the individual bags and are caused to displace as the bags are inflated and deflated, as will be discussed in later.

Figure 4A:
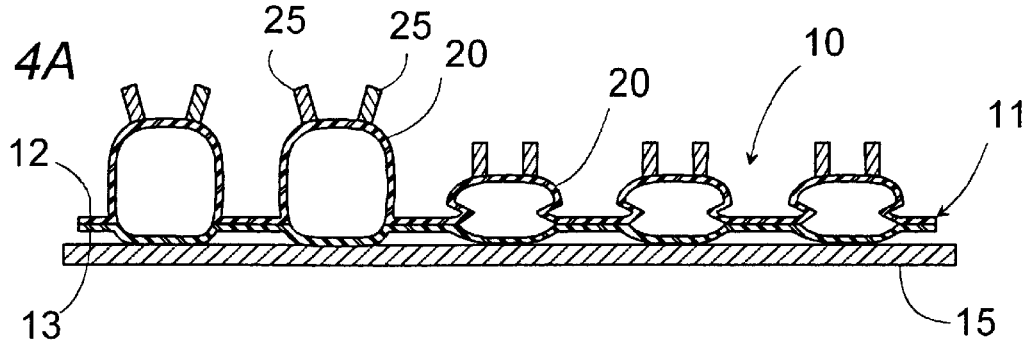
FIGS. 4A to 4C are sectional views illustrating the operation of the system.
Figure 4B:
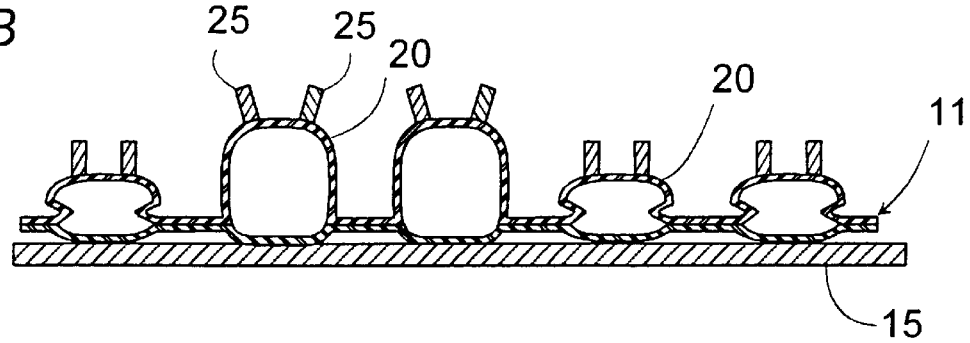
Figure 4C:
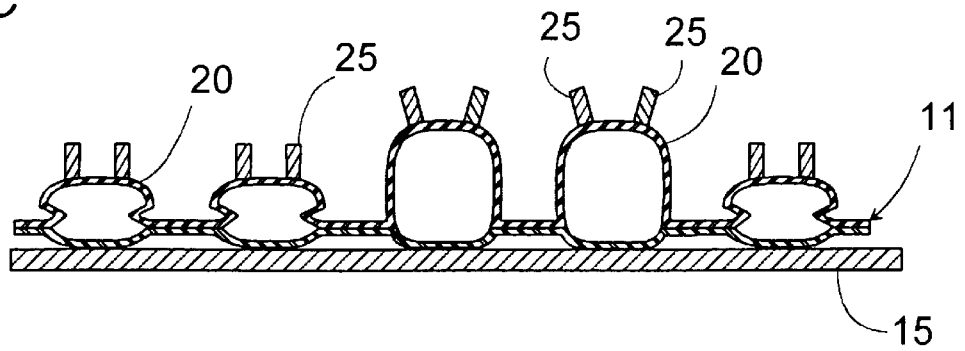

The control unit 30 includes a charging pump 31 which supplies a pressurized air to the individual bags 20 through a common feed path 33 and a corresponding number of fluid channels 34 branching from the feed path into the bags 20. Provided in the individual channels 34 are two-way valves 35 which act to charge and discharge the pressurized air into and from the bags, selectively for inflating and deflating the bags. The valves 35 are arranged to have their individual exhaust port connected to a single exhaust path 36 leading through a discharge pump 37 to an outside air. The discharge pump 37 operates to expedite the discharge of the pressurized air from the inflated bags for increasing an inflating rate of the bags and therefore a resulting massaging force. Stop valves 32 and 38 are provided respectively in the feed path 33 and the exhaust path 36 adjacent to the pumps. The pumps and valves are connected to a controller 40 which is programmed to give a desired operational sequence of inflating the bags successively, as shown in FIGS. 4A to 4C, or in other suitable manner. When the bags are successively inflated, the resulting massaging force or pressure proceeds as a wave in the direction perpendicular to the length of the bag. In this sense, this sequence is particularly suitable for treatment along the back of the user's body. The other sequence may be such that the bags are inflated in a random order or that a set of distant bags are inflated and deflated simultaneously, while activating the different set of the distant bags.

When inflated, the bag 20 is allowed by its flexibility to deform the top end wall 21 into a curved or rounded contour as shown in FIGS. 4A to 4C. With this result, the applicators 25 held on the top end wall 21 assumes a lateral movement in addition to vertical movement with respect to a general plane of the base sheet 11, thereby giving a combination of pressing and rubbing massage action to the user's body. Further, the two applicators 25 are positioned on the opposite lateral ends of the top end wall 21 of each bag 20 so that the distal top ends of the applicators moves laterally away from each other as the bag 20 is caused to inflate, as shown in FIGS. 4A to 4C. Thus, the applicators 25 in a pair can act to stretch the portion of the user's body confined between the applicators for adding an effective massage action to the simple pressing massaging action.

When the massage unit 10 is incorporated into the bed or the backrest of the chair, the massaging unit 10 is backed up with a covering 15 of the bed or backrest, as shown in FIGS. 4A to 4C. The covering 15 is usually of a flexible nature but show resistance against the inflation of the bags due to a relatively hard internal structure of bed or the backrest, thereby inflating the bags mainly towards the user's body and therefore giving sufficient massage action to the user's body. When, on the other hand, the massage unit 10 is used to surround the leg or arm of the user's body to make the applicators 25 in contact with the body, as shown in FIGS.

5 and 6, an additional backup sheet 16 may be utilized to surround the base sheet 11 in order to concentrate the massaging action inwardly to the leg or arm.

Figure 5:
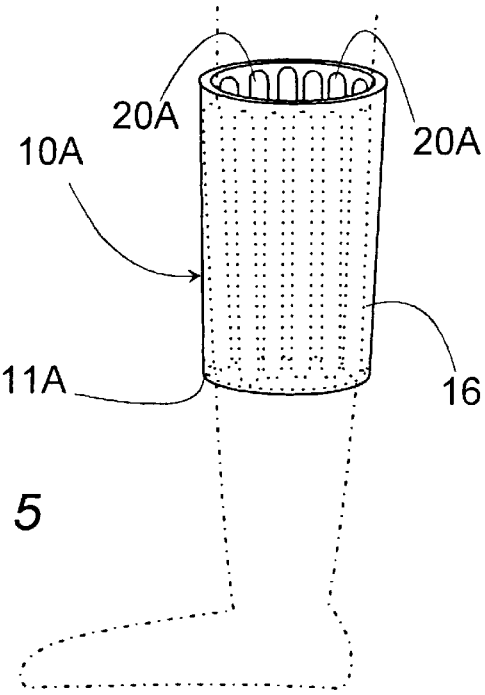
FIGS. 5 and 6 are diagrams respectively illustrating examples of using the system.
Figure 6:
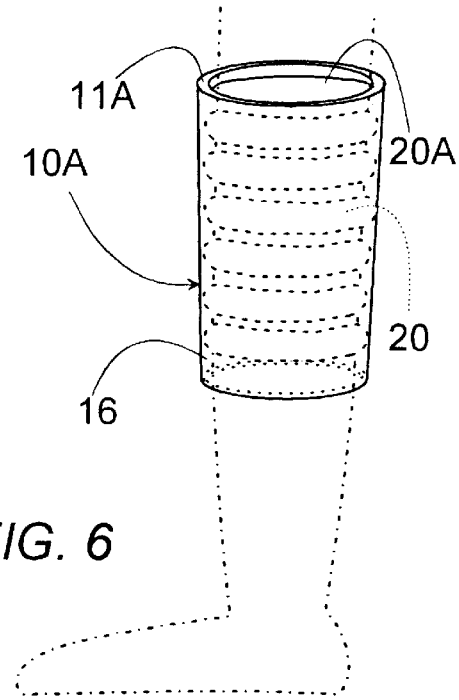

When the massage unit 10 is used to wrap the leg or the arm in a manner as shown in FIG. 5, the controller 40 may be programmed to operate inflating the bags 20 either in a successive sequence or in a random sequence. Further, the controller 40 may be programmed to operate inflating the bags 20 at circumferentially spaced locations, for example, diametrically spaced locations simultaneously to apply the combined massaging action to the selected portion of the body. In this case, the controller 40 is programmed to inflate sets of spaced bags 20 in a sequence. When the massage unit 10 is used in a manner as shown in FIG. 6, the controller 40 is preferred to be programmed to successively inflate the bags 20 along the length or the leg, although some other operation sequences may be programmed in the controller 40 to achieve a comfortable massaging action.

Turning back to FIG. 2, the controller unit 30 includes a temperature unit 41, for example, a heater, cooler, or heat-exchanger, which is disposed around the common feed path 33 to heat or cool the pressurized air being fed to the individual bags 20. The temperature unit 41 is also controlled by the controller 40 to give a suitable temperature to the pressurized fluid so that all the bags 20 are kept at a substantially the same temperature optimum for comfortable massage treatment.

Figure 7:
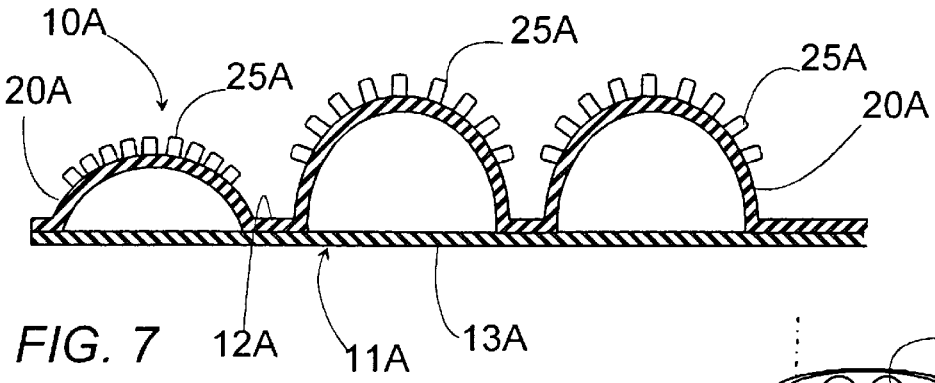
FIG. 7 is a sectional view illustrating a modification of the above system.
Figure 8:
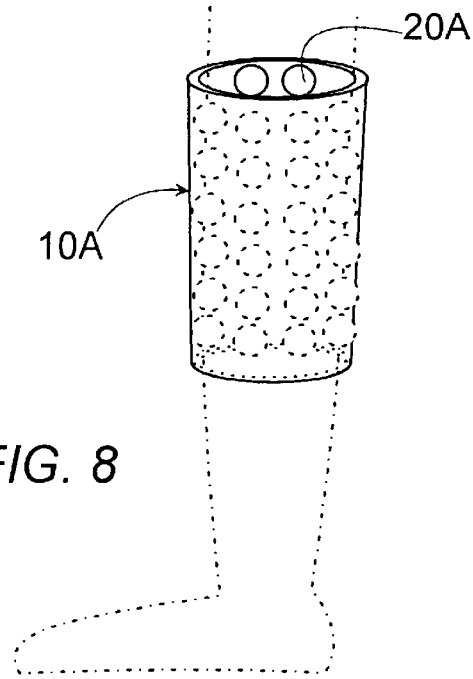
FIG. 8 is a diagram illustrating one example of using the system of FIG. 7.

FIG. 7 illustrates a modified massaging unit 10A which is identical to the above massage unit except that each bag 20A is shaped into semi-spherical or dome structure with a plurality of like applicators 25A projecting on a curved top end wall 21A. The base sheet 11A is composed of upper and lower flexible layers 12A and 13A which are partially heat-welded to define therebetween the separate bags 20A, in the same manner as in the first embodiment. The bags 20A are arranged in a two dimensional array to have rows and columns on the base sheet 11A. The bags 20A are connected to a like controller unit which controls to charge and discharge the pressurized air into and from the bags for selectively inflating and deflating the bags in a controlled sequence. When the bag 20 is inflated, the applicators 25A extend at a greater angle with respect to a vertical than at the deflated or collapsed condition, thereby assuming lateral movements for rubbing and stretching, as well as pressing the portion of the use's body in contact with the applicators. Thus structured massage unit 10A can be adapted in use to fit around the leg or arm of the user's body, as shown in FIG. 8, for concentrating local massaging actions to various specific points of the user's body. Operation sequence is determined by a programmable controller to effect inflating the bags successively or intermittently along the columns and rows or in combination of these for advancing the treatment in any desired directions optimum for the massage treatment.

Figure 9:
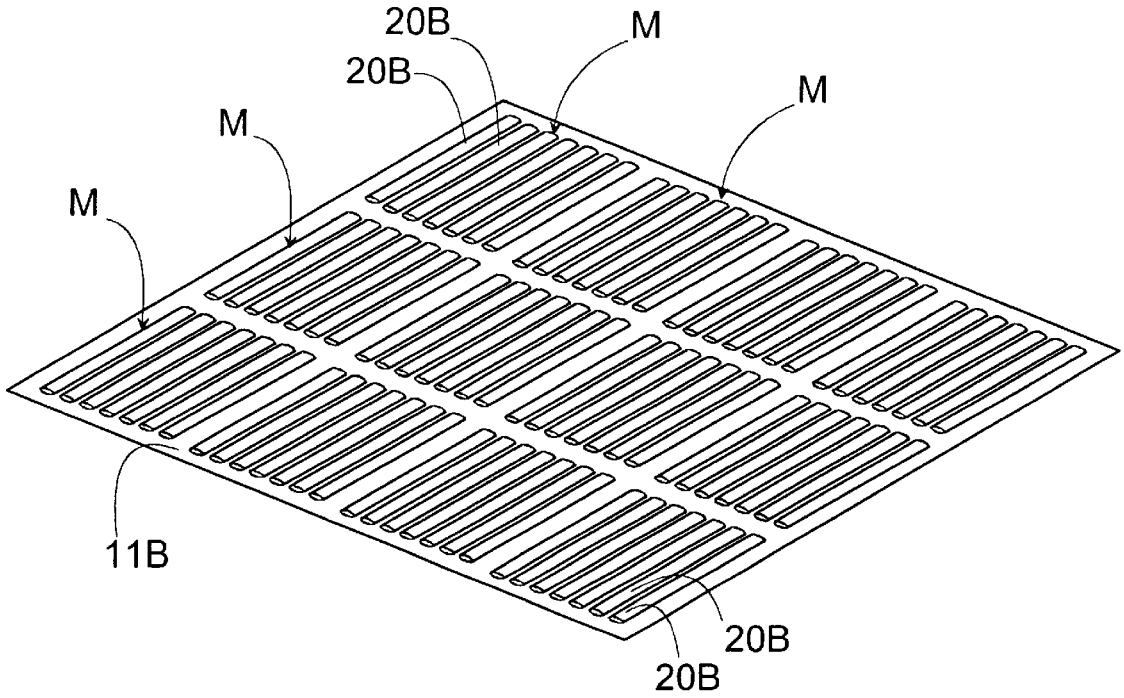
FIG. 9 is a perspective view of a massaging system in accordance with a second embodiment of the present invention.

FIG. 9 illustrates a massaging system in accordance with a second preferred embodiment of the present invention which is similar to the first embodiment expect that a massage unit 10B is configured to have a plurality of modules M each having a fixed number of the bags 20B. The modules M are arranged on a like base sheet 11B in a two-dimensional array having rows and columns. The bags 20B in each module M are of elongated configuration with a pair of applicators 25B on each bag, and extend in parallel with each other. The modules M are connected commonly to a single controller unit which is programmed to make a local operation of inflating the bags of each module in a predetermined sequence as well as to make an overall operation of activating the modules M in a predetermined sequence in tow-dimensional directions, for example, along the rows and columns or in combination thereof. Like parts are designated by like numerals with a suffix letter of "B".

Figure 10:
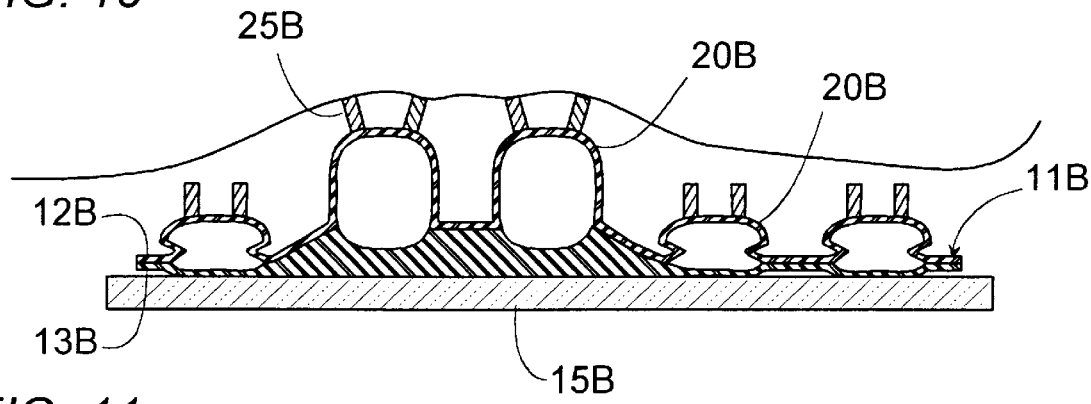
FIGS. 10 and 11 are sectional views respectively illustrating designs of elevating applicators of selected bags of the system.
Figure 11:
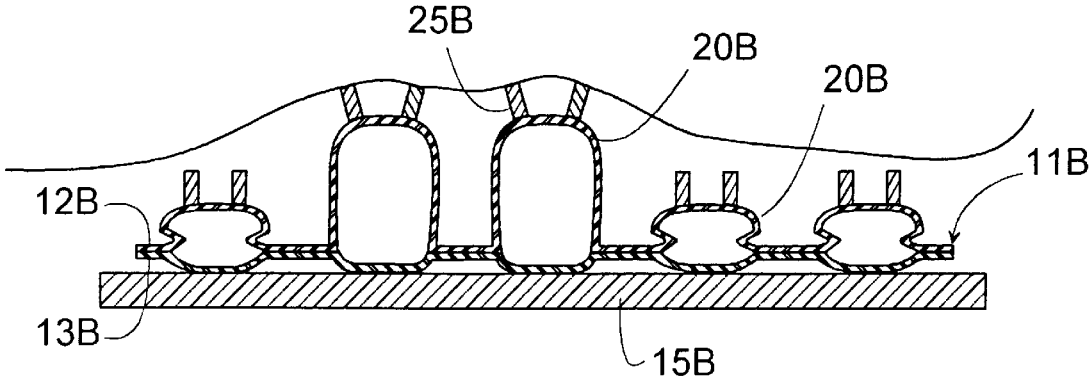

Particularly for the massage unit 10B which cover a wide area of the user's body, it is preferred to locate the applicators 25B of specific bags 20B at a higher elevation with respect to a general plane of the base sheet 11B than those of the remaining bags 20B in order to conform a massage unit 10B to a recessed contour of the user's body, such as a lower back of the body for giving effective massage action thereto. FIG. 10 illustrates one such scheme in which the specific bag 20B has its lower layer 13B of an increased thickness. Alternatively, as shown in FIG. 11, the specific bag 20B may be formed to have a greater volume or capacity than the others so as to raise the associated applicators 25B than those of the others. Further, it is possible to use a backup-sheet which is partially formed with a raised platform for supporting thereon the specific bag or bags.

Figure 12:
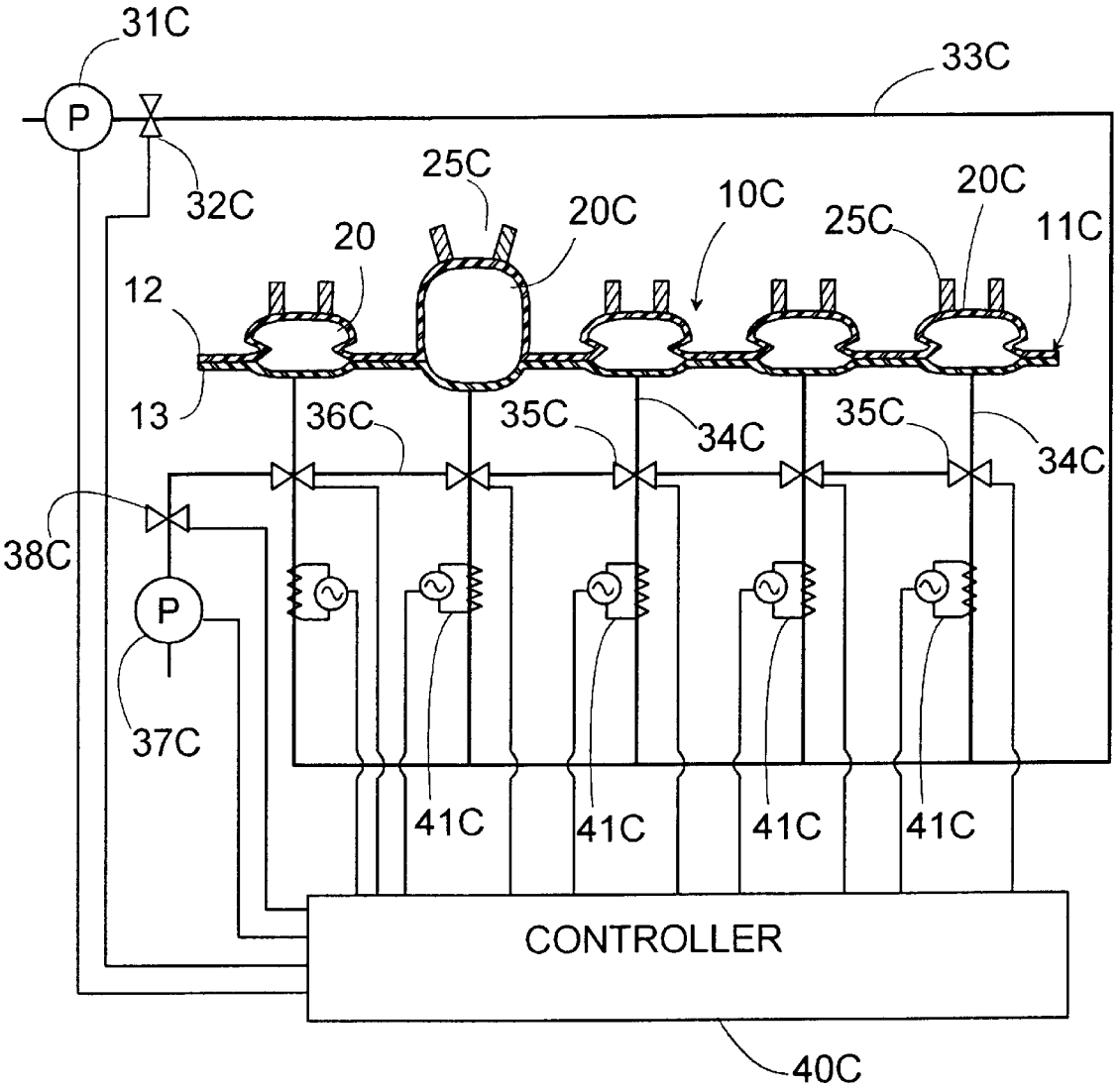
FIG. 12 is a schematic diagram illustrating a massaging system in accordance with a third embodiment of the present invention.

FIG. 12 illustrates a massaging system in accordance with a third embodiment of the present invention which is identical in structure and operation to those of the first embodiment except for a provision of a plurality of temperature units 41C around individual fluid channels 34C leading to the bags 20C, rather than around the common feed path 33C. The temperature units 41C, which may be a heater, cooler, or heat-exchanger to heat or cool the pressurized air just being introduced into the bags 20C, are controlled individually by a controller 40C to give different temperatures to different bags 20C in such a manner to realize an optimum temperature distribution over the massage unit 10C, affording a comfortable massaging environment to the user. Like parts are designated by like numerals with a suffix letter of "C".

Although the pressurized air is employed to inflate and deflate the bags in the above illustrated embodiments, any other suitable gas or liquid may be utilized.

What is claimed is:

1. A massaging system comprising:

a base sheet carrying a plurality of expandable bags arranged in a plane of said base sheet;

a charging and discharging unit connected to said bags for selectively supplying and discharging a pressurized fluid into and from said bags so as to inflate and deflate the bags, selectively;

at least one applicator which projects from each of said bags and is adapted in use to come into contact with a portion of a human body for applying a massaging action;

wherein each of said bags has a flexible top end wall which is capable of deforming into a curved contour when being inflated, said applicator being made of a hard material and projecting directly from said top end wall of the bag as an integral part of said bag such that said applicator is caused to displace in a direction different from a direction along which said bag inflates and deflates principally, as a consequence of that said flexible top end wall deforms into said curved contour, each of said bags is formed of a flexible material in its entirety including said flexible top end wall, and each of said applicators is made of a hard material inserted into a flexible sheath bonded to said tope end wall of the bag.

2. The massaging system as set forth in claim 1, wherein said base sheet is of a rectangular configuration having a length and a width, and said bags being of elongated configuration extending along the length of said base sheet and are arranged in parallel with each other, said applicator of each bag being in the form of an elongated fin which extends along a length of said bag.

3. The massaging system as set forth in claim 2, wherein each of said bags is formed with a pair of said applicators running in parallel with each other along the length of said bag, said applicators in a pair are being so positioned on said flexible top end wall as to displace distal ends of said applicators away from each other as said bag is caused to inflate.

4. The massaging system as set forth in claim 1, wherein each of said bags has a side wall in the form of a bellows.

5. The massaging system as set forth in claim 1, wherein said charging and discharging unit comprises:

a charging pump which supplies the pressurized fluid respectively through fluid channels into the individual bags;

a plurality of two-way valves each provided in each of said fluid channels for charging and discharging said pressurized fluid into and from said bag so as to inflate and deflate the bag; and a suction pump connected to said valves through a common exhaust path for positively discharging the pressurized fluid out of said bags, selectively.

6. The massaging system as set forth in claim 1, wherein said charging and discharging unit comprises:

a charging pump which supplies the pressurized fluid into a common feed path which is branched into a plurality of fluid channels each leading to each of said bags; and a plurality of two-way valves each provided in each of said fluid channels for charging and discharging said pressurized fluid into and from said bag so as to inflate and deflate the bag;

said system further including a single temperature control unit which is disposed around said common feed path for heating or cooling the pressurized fluid being supplied to said individual bags.

7. The massaging system as set forth in claim 1, wherein said charging and discharging unit comprises:

a charging pump which supplies the pressurized fluid into a common feed path which is branched into a plurality of fluid channels each leading to each of said bags; and a plurality of two-way valves each provided in each of said fluid channels for charging and discharging said pressurized fluid into and from said bag so as to inflate and deflate the bag;

said system further including a plurality of temperature control units which are disposed respectively around said individual fluid channels for heating or cooling the pressurized fluid being supplied to said individual bags.

8. The massaging system as set forth in claim 1, wherein said bags are grouped into a plurality of modules each having more than one bags, said modules being arranged within the plane of said base sheet to constitute an array having columns and rows, said system further including a controller which is programmed to inflate and deflate the bags successively along said column and rows.

9. The massaging system as set forth in claim 8, wherein each of said bags are of elongated configuration extending along one of said columns and rows, and said bags are arranged in parallel with each other within each of said modules.

10. The massaging system as set forth in claim 1, wherein said base sheet is made flexible so that it can be adapted in use to be wound around leg or arm of the human body.

11. The massaging system as set forth in claim 1, wherein at least one of said bags is disposed to have the corresponding applicator positioned at a higher level than those of the remaining bags with respect to a general plane of said base sheet.

12. The massaging system as set forth in claim 11, wherein said base sheet is made flexible so that it can be adapted in use to be wound around a leg or arm of the human body.

* * * * *